US012578161B2

(12) United States Patent
Evans

(10) Patent No.: US 12,578,161 B2
(45) Date of Patent: Mar. 17, 2026

(54) ARCHERY CAM SET FOR COMPOUND BOWS

(71) Applicant: Rocky Mountain Archery Ltd., Calgary (CA)

(72) Inventor: John D. Evans, Calgary (CA)

(73) Assignee: ROCKY MOUNTAIN ARCHERY LTD., Calgary (CA)

( * ) Notice: Subject to any disclaimer, the term of this patent is extended or adjusted under 35 U.S.C. 154(b) by 155 days.

(21) Appl. No.: 18/403,585

(22) Filed: Jan. 3, 2024

(65) Prior Publication Data

US 2024/0219140 A1 Jul. 4, 2024

Related U.S. Application Data

(60) Provisional application No. 63/478,338, filed on Jan. 3, 2023.

(51) Int. Cl.
*F41B 5/10* (2006.01)

(52) U.S. Cl.
CPC ..... *F41B 5/105* (2013.01)

(58) Field of Classification Search
CPC ..... F41B 5/105; F41B 5/10
USPC ..... 124/25.6
See application file for complete search history.

(56) References Cited

U.S. PATENT DOCUMENTS 4,686,955 A 8/1987 Larson
4,748,962 A 6/1988 Larson
4,774,927 A 10/1988 Larson
4,909,231 A 3/1990 Larson
4,967,721 A 11/1990 Larson
5,495,843 A * 3/1996 Larson ..... F41B 5/10 124/900
5,782,229 A * 7/1998 Evans ..... F41B 5/105 124/900
RE37,544 E * 2/2002 Darlington ..... F41B 5/10 124/900
6,792,930 B1 * 9/2004 Kronengold ..... F41B 5/105 124/25.6
7,721,721 B1 * 5/2010 Kronengold ..... F41B 5/10 124/90
9,121,658 B1 * 9/2015 Darlington ..... F41B 5/123
9,453,698 B1 * 9/2016 Grace ..... F41B 5/1411
9,885,535 B2 2/2018 Evans
(Continued)

*Primary Examiner* — John E Simms, Jr.
(74) *Attorney, Agent, or Firm* — Borden Ladner Gervais LLP; Richard A. Johnson

(57) ABSTRACT

A set of archery cam devices for an archery bow is disclosed herein, including first and second cam devices configured to be rotatably coupled to first and second limbs of an archery bow, and having first and second bowstring sheaves, first and second control sheaves, and first and second power cable sheaves. When the archery bow is vertically oriented: a vertical riser plane extends through the riser ends; a vertical bowstring plane extends through the first and second bowstring sheaves; a vertical control plane extends through the first and second control sheaves; first and second vertical power cable planes extend through the first and second power cable sheaves; the vertical bowstring plane and the vertical control plane are located on opposite sides of the vertical riser plane; and the first and second vertical power cable planes are located on opposite sides of the vertical riser plane.

26 Claims, 7 Drawing Sheets

(56) References Cited

U.S. PATENT DOCUMENTS

| | | | | |
|---|---|---|---|---|
| 2005/0268892 | A1* | 12/2005 | Gallops, Jr. | F41B 5/105<br>124/25.6 |
| 2010/0051005 | A1* | 3/2010 | Wilson | F41B 5/10<br>124/86 |
| 2010/0206284 | A1* | 8/2010 | Popov | F41B 5/10<br>124/88 |
| 2010/0269808 | A1* | 10/2010 | Evans | F41B 5/10<br>124/86 |
| 2017/0051996 | A1* | 2/2017 | Evans | F41B 5/10 |
| 2018/0094894 | A1* | 4/2018 | Prater | F41B 5/105 |

* cited by examiner

ARCHERY CAM SET FOR COMPOUND BOWS

CROSS-REFERENCE TO RELATED APPLICATION

This application is a non-provisional of, and claims the benefit and priority of, U.S. Provisional Patent Application No. 63/478,338, filed on Jan. 3, 2023. The entire contents of such application are incorporated herein.

FIELD OF THE INVENTION

The present invention relates to compound bows (such as compound bows used for archery or hunting), sets of cams therefore, and methods related thereto.

BACKGROUND

Compound archery bows are known to have a bowstring, on which an arrow may be nocked, along with one or more portions of cable other than the bowstring extending between the limbs of the bow. Such cable portions, sometimes referred to as "power cables", are generally located at least partly within or close to an operating plane of the bowstring. The power cables thus interfere with shooting arrows.

In order to provide adequate room for the arrow, it is conventional practice to mount a cable guard on the bow to engage the central portions of the power cables and to displace them laterally a sufficient distance to one side of the operating plane of the bowstring to avoid interference with an arrow. One drawback associated with conventional cable guards is that, in displacing the center of a power cable laterally from its straight line position, they introduce a lateral component to the force exerted by the power cable against the limbs. This lateral torque not only decreases the accuracy of arrow flight, but also causes twisting of the limbs, cams, wheels and/or handle, and thereby contributes adversely to shortening their useful life. Conventional cable guards also cause the power cables to feed on and off of the cams and wheels at an angle. This may sometimes lead to the power cables becoming dislodged from the cams and/or wheels.

The foregoing background describes some, but not necessarily all, of the problems, disadvantages and shortcomings related to the known compound bows and cam devices therefore.

SUMMARY

In accordance with an aspect of the present invention, there is provided a compound bow comprising: a riser portion having a first limb and a second limb extending outwardly therefrom; a first cam device pivotally coupled to the first limb by a first axle, the first cam device comprising a first bowstring sheave and a first control sheave located on opposite sides of a first power cable sheave; a second cam device pivotally coupled to the second limb by a second axle, the second cam device comprising a second bowstring sheave and a second control sheave located on opposite sides of a second power cable sheave; a bowstring extending from the first bowstring sheave to the second bowstring sheave; a support cable under tension extending from the first control sheave to the second control sheave; a first power cable under tension having a first end attached to the first power cable sheave and a second end comprising a split portion attached to a second pair of attachment points proximate the outer end of the second limb; a second power cable under tension having a first end attached to the second power cable sheave and a second end comprising a split portion attached to a first pair of attachment points proximate the outer end of the first limb; wherein the first power cable sheave and second power cable sheave are each slightly laterally offset from a vertical central axis of the compound bow in opposite directions, such that the first power cable and second power cable maintain at least a minimum spacing therebetween and provide substantially balanced torsional force distribution with respect to the vertical central axis when the compound bow is in a firing position.

In another embodiment, a set of archery cam devices includes a first cam device configured to be rotatably coupled to a first limb of an archery bow. The first cam device has a first bowstring sheave, a first control sheave, and a first power cable sheave. The set also includes a second cam device configured to be rotatably coupled to a second limb of the archery bow. The second cam device has a second bowstring sheave, a second control sheave, and a second power cable sheave. When the first and second cam devices are coupled to the first and second limbs, respectively, while the archery bow is vertically oriented: a vertical riser plane extends through the riser ends; a vertical bowstring plane extends through the first bowstring sheave and the second bowstring sheave; a vertical control plane extends through the first control sheave and the second control sheave; a first vertical power cable plane extends through the first power cable sheave; a second vertical power cable plane extends through the second power cable sheave; the vertical bowstring plane and the vertical control plane are located on opposite sides of the vertical riser plane; and the first and second vertical power cable planes are located on opposite sides of the vertical riser plane.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

BRIEF DESCRIPTION OF THE DRAWINGS

Non-limiting embodiments of the invention will now be described, by way of example only, with reference to the attached figures.

Figure 1:
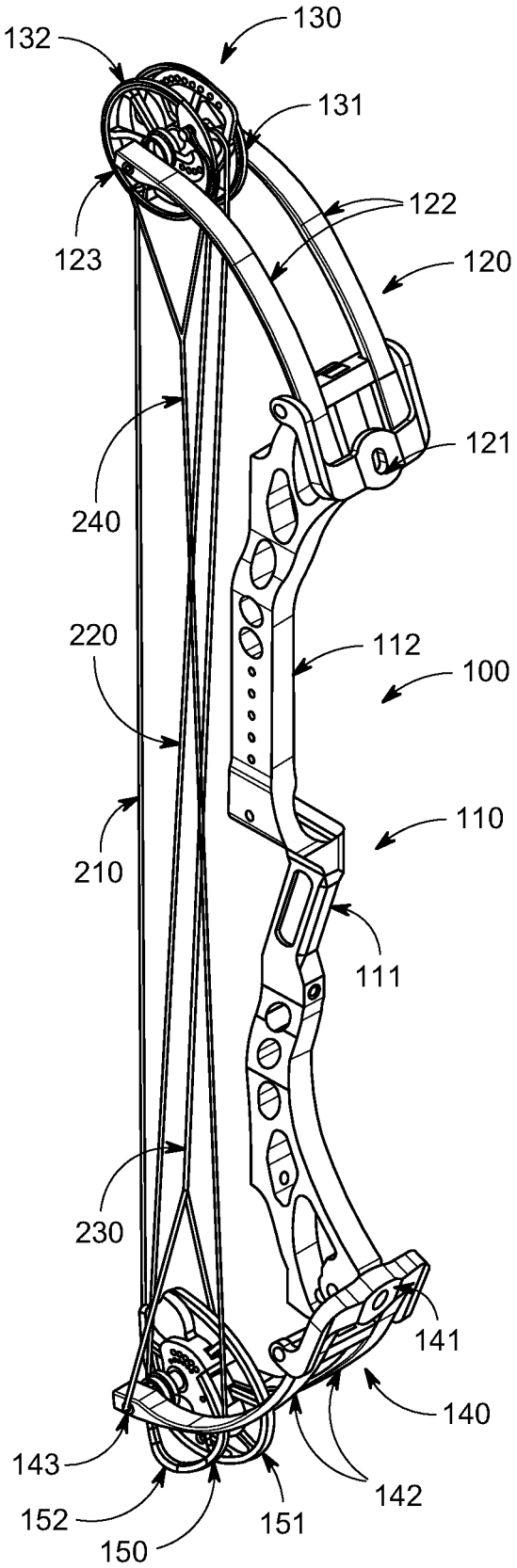
FIG. 1 illustrates a front isometric view of an embodiment of a compound bow including cam devices in accordance with the present invention.
Figure 2:
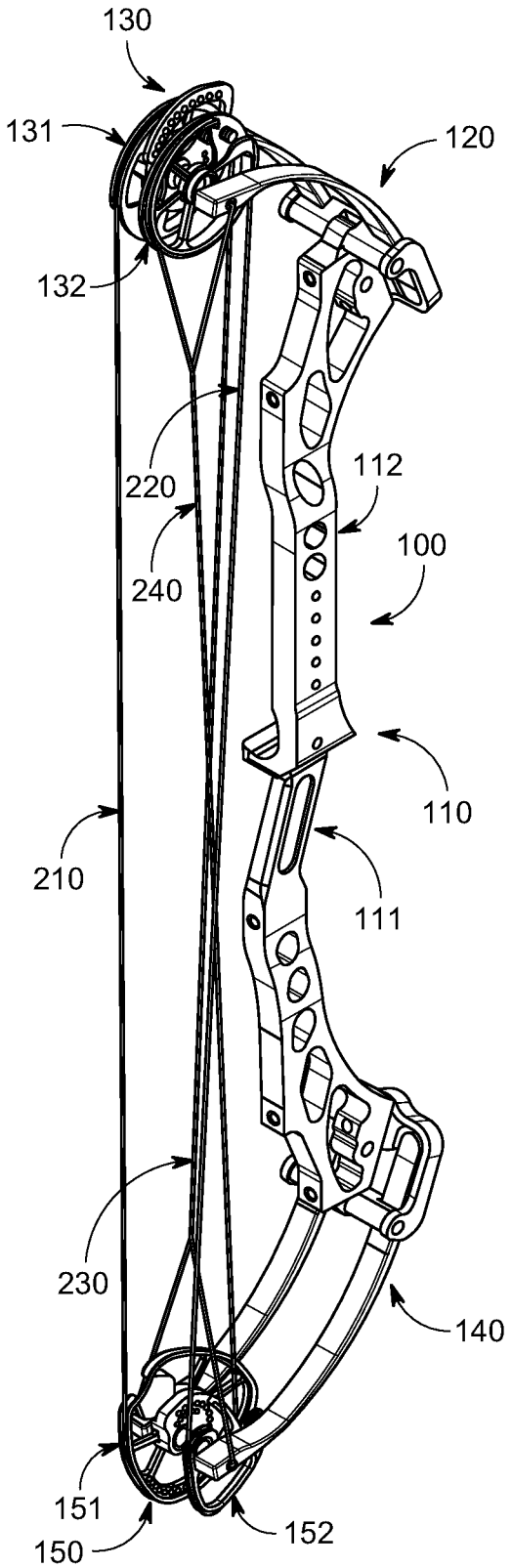
FIG. 2 illustrates a rear isometric view of the embodiment of the compound bow of FIG. 1.

In the drawings, embodiments of the invention are illustrated by way of example. It is to be expressly understood that the description and drawings are only for the purpose of illustration and as an aid to understanding, and are not intended as a definition of the limits of the invention.

DETAILED DESCRIPTION

Throughout the following description specific details are set forth in order to provide a more thorough understanding to persons skilled in the art. However, well known elements may not have been shown or described in detail to avoid unnecessarily obscuring the disclosure. Accordingly, the description and drawings are to be regarded in an illustrative, rather than a restrictive, sense.

Furthermore, throughout this disclosure set forth herein, the word "including" indicates or means "including, without limitation," the word "includes" indicates or means "includes, without limitation," the phrases "such as" and "e.g." indicate or mean "including, without limitation," and the phrase "for example" refers to a non-limiting example.

Figure 6:
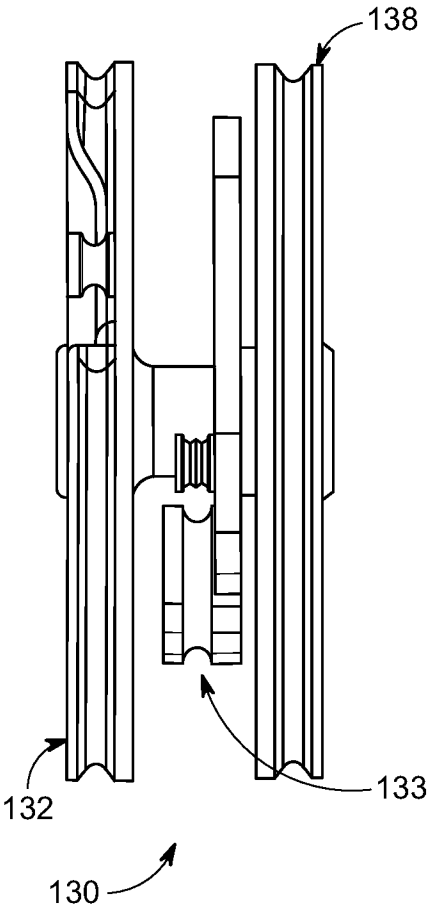
FIG. 6 illustrates a front side elevation view of the embodiment of the cam device of FIG. 5.
Figure 7:
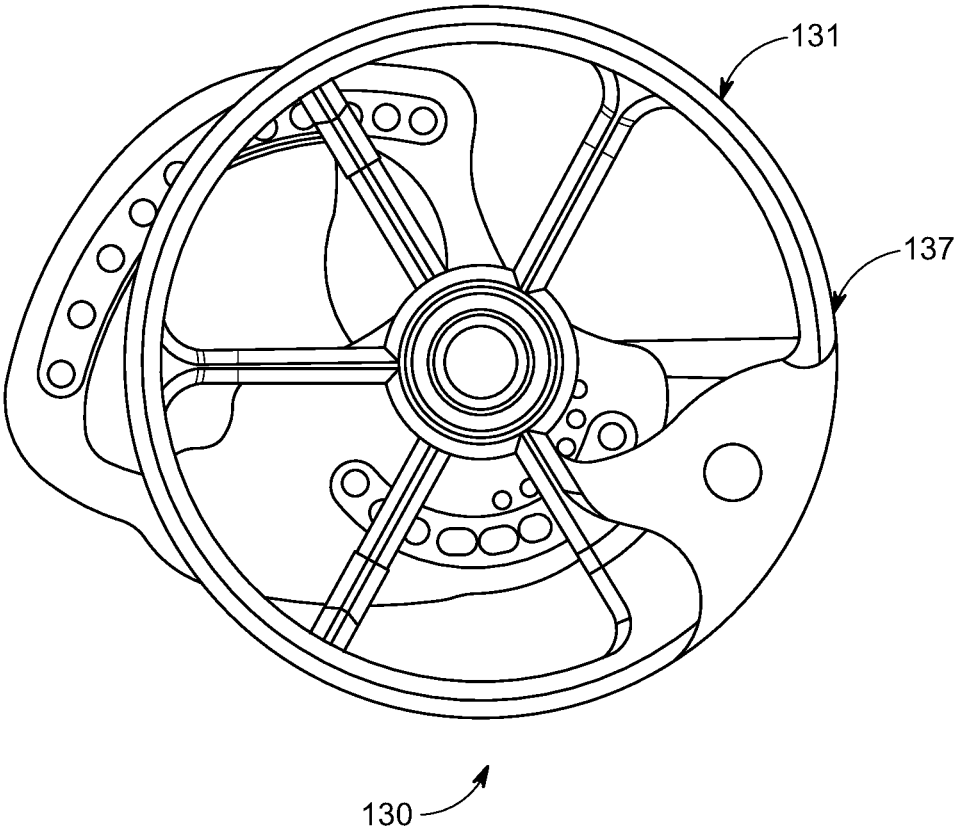
FIG. 7 illustrates a left side elevation view of the embodiment of the cam device of FIG. 5.
Figure 8:
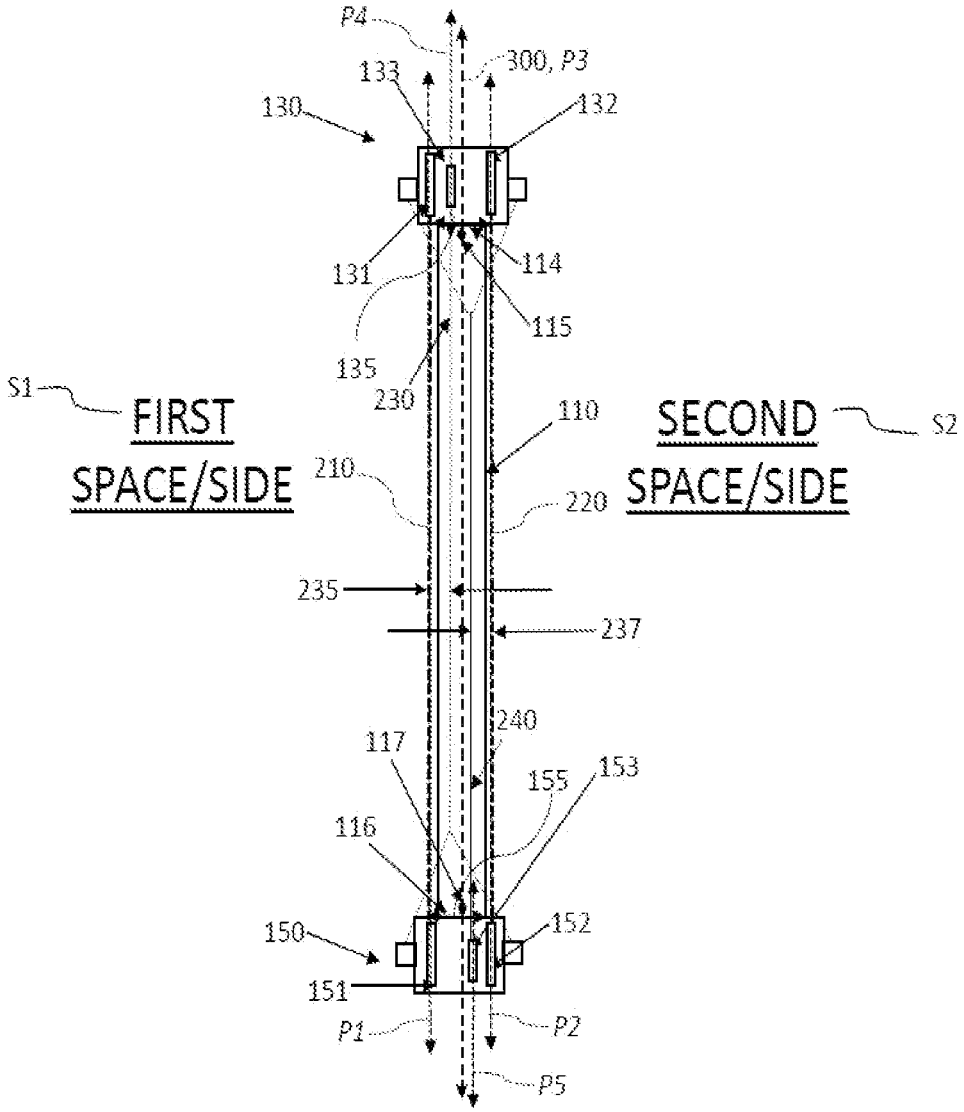
FIG. 8 is a schematic diagram that illustrates an embodiment of a set of cam devices that are rotatably mounted to a plurality of limbs of a riser portion of a compound bow.

FIGS. 1-8 show a compound bow 100 according to one embodiment of the invention. Referring to FIG. 1, compound bow 100 comprises a riser portion 110 extending from a first riser end 114 to a second riser end 116. A vertical central axis 300 (which lies in a vertical central plane P3 or vertical riser plane P3, as shown in FIG. 8) extends through a center point 115 at the first riser end 114 and a center point 117 at the second riser end 116. In an embodiment, a segment of the bowstring 210, when moving toward a shooting target, travels along such vertical central plane. In another embodiment, such vertical central plane P3 extends through a vertical segment of the bowstring 210. The riser portion 110 may come in a variety of shapes and configurations, where different parts of the riser portion 110 provide different functions or benefits when using the compound bow 100. In the illustrated embodiment, the riser portion 110 has limb holders, "limb pockets" or "limb cups" at the first and second riser ends 114, 116 for receiving a portion of an archery limb or limb 120, 140. As shown in the figures, the limbs 120, 140 are split limbs that include a pair of flexible fingers or limb fingers 122, 142, as discussed further below. The limbs 120, 140 extend outwardly from the riser portion 110. Each limb 120, 140 is typically connected to the riser portion 110 at opposite ends of the riser portion 110. Each limb 120, 140 may be integrally formed into the riser portion 110 itself, or, more preferably may be secured to the riser portion by respective limb bolts 121, 141. In some embodiments characteristics of how the limbs 120, 140 interact with the rest of compound bow 100 may be adjusted by tightening or loosening limb bolts 121, 141.

For the purposes of this embodiment, limb 120 may be referred to as the first limb, or upper limb, while limb 140 may be referred to as the second limb, or lower limb. Each of the first and second limbs 120, 140 may comprise a number of first limb fingers 122 and second limb fingers 142 in accordance with a split limb configuration. In the embodiment shown in FIG. 1, the first limb 120 includes two first limb fingers 122, and the second limb 140 includes two second limb fingers 142. The first and second limb fingers 122, 142 are shown in one configuration in FIG. 1, however many arrangements, sizes, and shapes of the first and second limb fingers 122, 142 may be possible. As shown, each pair of first and second limb fingers 122, 142 may be spaced apart from each other to define a gap between the first limb fingers 122 and a gap between the second limb fingers 142. Still referring to FIG. 1, the first and second limb fingers 122, 142 may each be secured to a limb support by the limb bolts 121, 141 at one end. The opposite ends of the first limb fingers 122 are spaced apart from each other such that a first cam device 130 is positioned between the opposite ends of the first limb fingers 122. Similarly, opposite ends of the second limb fingers 142 are spaced apart from each other such that a second cam device 150 is positioned between the opposite ends of the second limb fingers 142. In other embodiments, the first and second limbs 120, 140 could be differently configured, for example, one or both of the first and second limbs 120, 140 could be formed of a single piece of material with a split end that defines a gap for receiving the first and second cam devices 130, 150, respectively.

In an embodiment, each of the cam devices 130, 150 includes a rotor, wheel or pulley. In an embodiment, the cam devices 130, 150 include eccentric cams that rotate relative to the limbs 120, 140, respectively. Each such eccentric cam has one or more elliptical, asymmetric or non-circular lever portions configured to: (a) engage the drawstring or bowstring 210; and (b) engage the power line, power cord set or power cable 230 or 240. The bowstring 210 and power cables 230, 240 are at least partially spooled on the rotors or cam devices 130, 150.

A pair or set of cam devices 130, 150 (also referred to herein as cam set, cam device set or rotor set) is installable on the compound bow 100 or any other compatible type of archery bow. In some embodiments, a set of cam devices 130,150 as disclosed herein are configured for installation on a crossbow. Accordingly, the set of cam devices 130, 150 is configured to be coupled to the compound bow 100 to achieve the functionality and advantages described herein.

Referring to FIG. 1, the first cam device 130 may be pivotally and/or rotationally coupled to the first limb 120 by a first axle 123 running between the pair of first limb fingers 122. The second cam device 150 may be pivotally and/or rotationally coupled to the second limb 140 by a second axle 143 running between the pair of second limb fingers 142. More details of first cam device 130 may be seen in FIGS. 5, 6, and 7, where it is shown in isolation.

For compound bows, sheaves are used, especially in cam devices, to direct strings or cables. In prior art, conventional compound bows, the bowstring and other cables are substantially in-line with one another, and the cables are pulled to one side using a cable guard to keep the cables out of the arrow's (or projectile's) line of fire. The compound bow 100 described herein eliminates the need for such a cable guard by incorporating the inventive set of cam devices 130, 150, which spaces the bowstring 210 apart from the other cables 230, 240.

Figure 3:
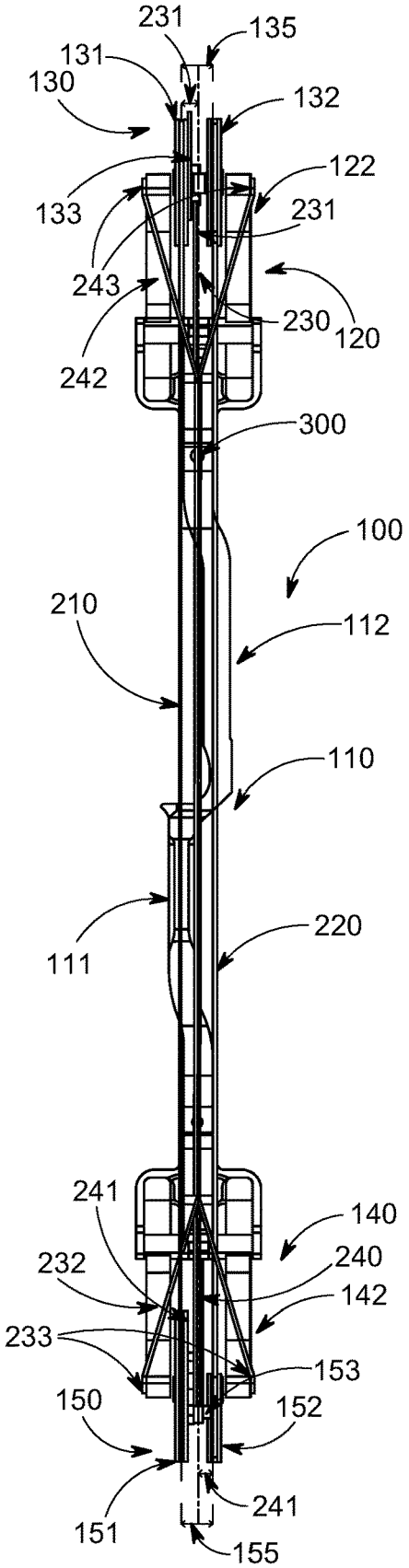
FIG. 3 illustrates a rear elevation view of the embodiment of the compound bow of FIG. 1.

With reference to FIG. 3 and FIG. 8, the first cam device 130 may comprise a first bowstring groove, valley or sheave 131 and a first control groove, valley or sheave 132 located on opposite sides of a first power cable sheave 133. Similarly, a second cam device 150 may comprise a second bowstring groove, valley or sheave 151 and a second control groove, valley or sheave 152 located on opposite sides of a second power cable sheave 153.

The compound bow 100 has a draw cord or bowstring 210 extending from the first bowstring sheave 131 to the second bowstring sheave 151, and a support cable 220 under tension extending from the first control sheave 132 to the second control sheave 152. The positioning of the bowstring 210 and support cable 220 is dictated by the arrangements of the sheaves 131, 132, 151 and 152. As shown in the embodiments of FIGS. 3 and 8, the bowstring 210 is positioned to one side of the vertical central axis 300 (or the vertical central plane in which the vertical central axis 300 lies), and the support cable 220 is positioned to the other, opposing side of the vertical central axis 300 (or the vertical central plane in which the vertical central axis 300 lies) of the riser portion 110.

The compound bow 100 further includes a first power cable 230 under tension having a first end 231 attached to the first power cable sheave 133 and a second end comprising a split portion 232 attached to a second pair of attachment points 233 proximate the outer end of the second limb 140. As shown in FIGS. 1-3 and 8, the attachment points 233 are positioned on or proximate each finger 122 of the first limb 120 such that the second cam device 150 is positioned between the attachment points.

The compound bow 100 further includes a second power cable 240 under tension having a first end 241 attached to the second power cable sheave 153 and a second end comprising a split portion 242 attached to a first pair of attachment points 243 proximate the outer end of the first limb 120. As shown in FIGS. 1-3 and 8, the attachment points 243 are on or proximate each finger 142 of the second limb 140 such that the first cam device 130 is positioned between the attachment points.

In an embodiment, the first bowstring sheave 131 and first control sheave 132 may be spaced apart by a first distance 135 (as shown in FIGS. 3 and 8) measured along the first axle 123. The second bowstring sheave 151 and the second control sheave 152 may be spaced apart by a second distance 155 measured along the second axle 143. Referring to FIG. 8, in an embodiment, the first distance 135 and second distance 155 are equal (or substantially equal) such that: (a) the first and second bowstring sheaves 131, 151 are aligned with and intersected by the same vertical bowstring plane P1; and (b) the first and second control sheaves 132, 152 are aligned with and intersected by the same vertical control plane P2. In this embodiment, planes P1 and P2 are parallel to the vertical central axis 300. Accordingly, planes P1 and P2 are parallel to the vertical central plane or vertical riser plane P3 in which the vertical central axis 300 lies.

Still referring to FIGS. 3 and 8, a first vertical power cable plane P4 (FIG. 8) extends through the first power cable sheave 133, and a second vertical power cable plane P5 (FIG. 8) extends through the second power cable sheave 153. In this embodiment, the first and second power cable sheaves 133 and 153 are configured such that first power cable 230 and second power cable 240 are positioned to be intersected by parallel planes that are slightly offset from one another in opposite directions from the vertical central axis 300 (and vertical central plane P3) of the riser portion 110. For example, in the embodiment the first power cable sheave 133 is slightly closer to the first bowstring sheave 131 than the first control sheave 132, and the second power cable sheave 153 is slightly closer to the second control sheave 152 than the second bowstring sheave 151. In some embodiments, the first power cable 230 and second power cable 240 do not come into contact and maintain a spacing of at least 0.5 mm from one another along their entire lengths. The vertical central axis 300 is located in-between the first and second power cables 230, 240, and in some embodiments the offset of each of the first and second power cables 230, 240 from the vertical central axis 300 (and vertical central plane P3) is selected based on the tension in the cables (i.e. if the first and second power cables 230, 240 have the same tension, they are each offset from the vertical central axis 300 by the same distance). Provided that the locations of the first and second power cables 230, 240 results in a balancing of twisting or torsional forces on the compound bow 100, many different arrangements are possible, and are intended to be within the scope of the present invention. The configuration presently preferred is as shown in the attached FIGS. 1-4 and 8. For example, the first power cable sheave 133 may be approximately 2 mm closer to the first bowstring sheave 131 than the first control sheave 132. To provide for balanced twisting or torsional force distribution on the compound bow 100, in this example, the second power cable sheave 153 may be positioned approximately 2 mm closer to the second control sheave 152 than the second bowstring sheave 151.

With regards to the locations of the first and second bowstring sheaves 131, 151 and first and second control sheaves 132, 152, the first distance 135 and second distance 155 are sized to position the bowstring 210 and support cable 220 on either side of the vertical central axis 300 for substantially balanced torsional force distribution with respect to the vertical central axis 300 when the compound bow 100 is in a firing position. Although these components are shown in the Figures such that the first and second distances 135 and 155 are substantially equal, that need not necessarily be the case. The first and second bowstring sheaves 131, 151 and the first and second control sheaves 132, 152 may be positioned and sized differently provided their locations and other characteristics are selected to achieve a substantial balancing of twisting or torsional force distribution with respect to the vertical central axis 300 of the riser portion 110 of the compound bow 100 when in a firing position.

As shown in FIG. 8, the vertical central plane or vertical riser plane P3 bounds or defines a first space S1 (located, for example, on the left side of the plane P3) extending in a first lateral direction (e.g., to the left), and the vertical riser plane P3 also defines a second space S2 (located, for example, on the right side of the plane P3) extending in a second lateral direction (e.g., to the right) opposite of the first lateral direction. The vertical bowstring plane P1 extends through the first space S1, the first bowstring sheave 131 and the second bowstring sheave 151. Also, the vertical control plane P2 extends through second space S2, the first control sheave 132, and the second control sheave 152. In addition, the first vertical power cable plane P4 extends through the first space S1 and the first power cable sheave 133. Furthermore, a second vertical power cable plane P5 extends through the second space S2 and the second power cable sheave 153.

Figure 4:
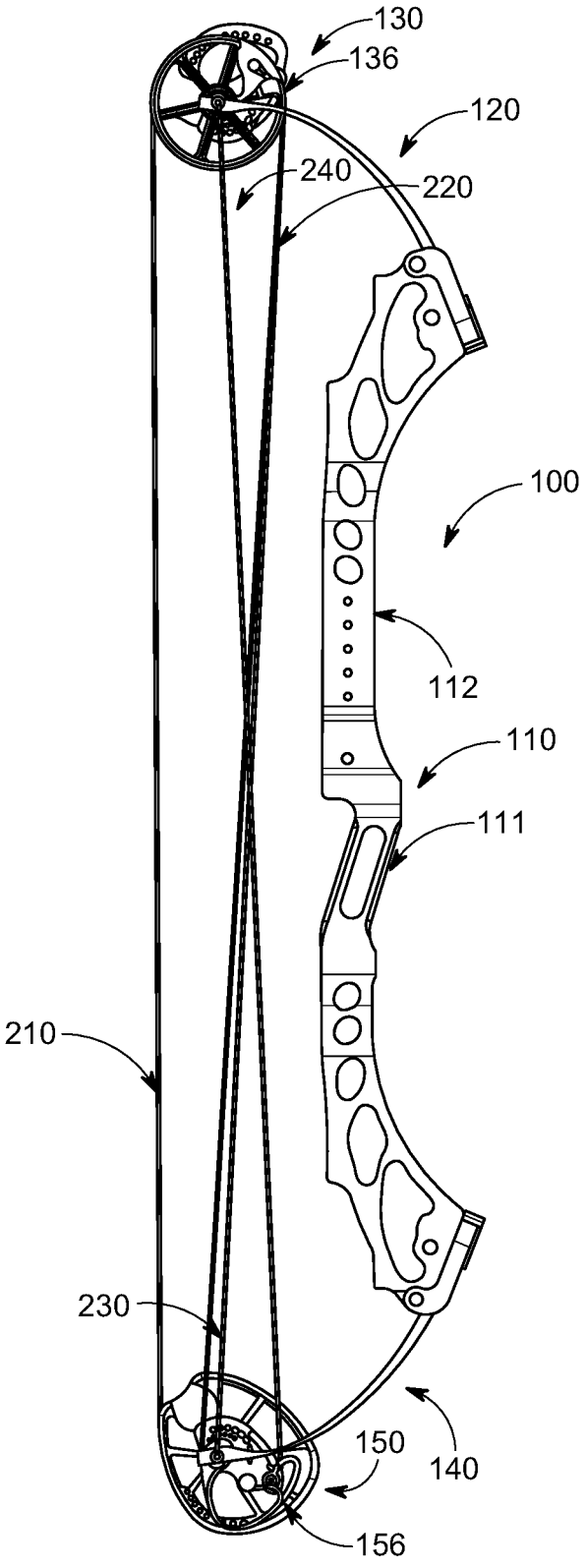
FIG. 4 illustrates a side elevation view of the embodiment of the compound bow of FIG. 1.

With reference to FIGS. 3, 4 and 8, as the bowstring 210 is pulled back along a bowstring plane P1 into a position for firing the compound bow 100, the bowstring 210 pulls on one side of the first cam device 130, thereby rotating both first bowstring sheave 131 and first control sheave 132 in a counter-clockwise direction. By rotating the first control sheave 132 in the counter-clockwise direction, the support cable 220 pulls up on second control sheave 152 at the same time as the bowstring 210 pulls up on second bowstring sheave 151, which causes second cam device 150 to rotate in a clockwise direction. The rotation of the first cam device 130 causes the first power cable 230 to pull back or exert a force on the fingers 142 of second limb 140, while the rotation of the second cam device 150 causes the second power cable 240 to pull back or exert a force on the fingers 122 of first limb 120. The bowstring 210 and the support cable 220 may be secured to the first and second bowstring sheaves 131, 151, and first and second control sheaves 132, 152 in a variety of positions, and in a variety of manners, to facilitate the described actions and movements.

In an embodiment, this combination of cables 220, 230, 240 and sheaves 132, 133, 152, 153 enables the pulling forces to be evenly laterally distributed to the first limb 120 and second limb 140 to reduce or eliminate any undesirable twisting or torsional forces that may otherwise have been imparted on the compound bow 100 by the pulling of bowstring 210.

In a conventional compound bow, a cable guard may be used to pull or divert any support cables over to one side near where an arrow or projectile is loaded to the bowstring. The cable guard inhibits the support cables from contacting or impeding the bowstring, however the cable guard also exerts undesirable lateral forces on the compound bow, which impeded performance. As shown in FIG. 3, the support cable 220 and bowstring 210 are positioned on either side of the first and second power cables 230, 240 such that bowstring 210 could be fully pulled back into a position for firing and released without the support cable 220 or the first and second power cables 230, 240 interfering with, contacting or impeding movement of the bowstring 210.

In an embodiment, referring to FIG. 8, the first power cable 230 may be attached to the first cam device 130 at a first attachment distance 235 from the first bowstring sheave 131, the second power cable 240 is attached to the second cam device 150 at a second attachment distance 237 from the second control sheave 152. The first attachment distance 235 of the first power cable 230 and second attachment distance 237 of the second power cable 240 position the first power cable 230 and second power cable 240 relative to the bowstring 210 to enable firing of an arrow or projectile free from interference by the first power cable 230 and second power cable 240 and without the use of a cable guard. The first attachment distance 235 and the second attachment distance 237 may therefore be substantially equal in order to achieve this functionality. If the various sheaves are different sizes, weights, or weight-distributions, the distances 235, 237 may be changed and may vary from one another in order to achieve the intended reduction or elimination of partially lateral-directed, twisting or torsional forces on the compound bow 100.

In an embodiment, the riser portion 110 may comprise a handle, grip portion or grip 111 that is offset from the vertical central axis 300 to one side (e.g. to the left when viewed from the rear) so as to be substantially aligned with the bowstring 210, and a sight window portion 112 that is offset from the vertical central axis 300 to the other side (e.g. to the right when viewed from the rear) to define a sight window between the grip 111 and the first limb 120. As shown in FIG. 3, the grip 111 may be substantially aligned with the bowstring 210, and the sight window portion 112 may be substantially aligned with the support cable 220.

In some embodiments, such as those shown in FIGS. 3 and 8, the first distance 135 between the first bowstring sheave 131 and the first control sheave 132 and the second distance 155 between the second bowstring sheave 151 and the second control sheave 152 may be substantially equal. In an embodiment, the positional spacing of the first and second bowstring sheaves 131, 151 and the first and second control sheaves 132, 152 in the first and second cam device 130, 150, as shown, results in the bowstring 210 and support cable 220 being arranged substantially parallel to each other for the length of the compound bow 100.

In some embodiments, such as that shown in FIG. 4, the first end 231 of the first power cable 230 may be attached to the first power cable sheave 133 proximate a front edge 136 of the first power cable sheave 133 spaced from the first axle 123 (FIG. 1). The first end 241 of the second power cable 240 may be attached to the second power cable sheave 153 proximate a front edge 156 of the second power cable sheave 153 spaced from the second axle 143 (FIG. 1). These attachments may take the form of a pin, screw, bolt, or other suitable attachment mechanism. In different embodiments of the present invention, the precise location of the attachment points may vary.

Figure 5:
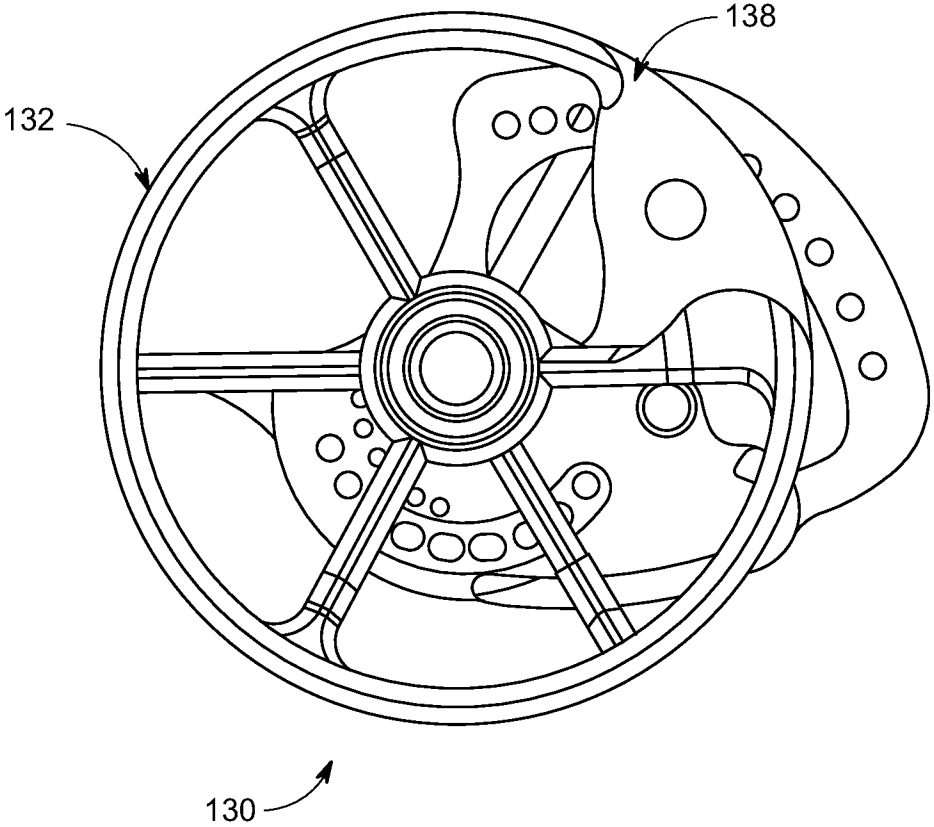
FIG. 5 illustrates a right side elevation view of an embodiment of the cam device shown in FIGS. 1-4.

In some embodiments, the first and second bowstring sheaves 131, 151 and the first and second control sheaves 132, 152 may vary in diameter, shape, size, thickness, material, and other properties. For example, the first bowstring sheave 131 and the first control sheave 132 may have substantially similar diameters as shown in FIGS. 5-7. Adjusting the diameter sizes of sheaves 131 and 132 may affect the twisting or torsional forces imparted on compound bow 100, so sizes of sheaves 131 and 132 should be selected to balance those forces. The first bowstring sheave 131 and first control sheave 132 may be circular for the majority of their respective circumferences, and may have respective cut-out portions 137 and 138 to provide for attachment of the bowstring 210 and support cable 220.

In some embodiments, including in the example shown in FIGS. 1-4, the second bowstring sheave 151 may have a larger diameter than the second control sheave 152. Each of sheave 151 and 152 may be of irregular shape, or may be similar in appearance to the sheaves 131, and 132 shown in FIGS. 5-7.

Embodiments of the compound bow 100 shown in the Figures may be configured for a person to hold the grip 111 on the riser portion 110 with the person's right hand, and pull the bowstring 210 with the person's left hand. The shape of the riser portion 110 and ordering of the bowstring 210 and support cable 220, and respective first and second cam devices 130, 150 may all be mirrored with respect to the embodiments shown in FIGS. 1-4 and 8 in order to provide for a variation of the compound bow 100 where the grip 111 is to be held with a person's left hand, and the bowstring 210 pulled with the person's right hand.

Any of the sheaves described herein may have a number of openings formed therethrough, as shown in the illustrated embodiments, for example to reduce the weights of the sheaves thereof. Each sheave may have a greater or lesser number or size of openings than shown in the figures, or may be generally solid.

Additional embodiments include any one of the embodiments described above, where one or more of its components, functionalities or structures is interchanged with, replaced by or augmented by one or more of the components, functionalities or structures of a different embodiment described above.

In an embodiment, with respect to each of the cam devices 150, 130, the arrangement or set of cam devices 150, 130, and the compound bow 100, the parts, components, and structural elements thereof can be combined into an integral or unitary, one-piece object through welding, soldering, plastic molding other methods, or such parts, components, and structural elements can be distinct, removable items that are attachable to each other through screws, bolts, pins and other suitable fasteners.

In the foregoing description, certain components or elements may have been described as being configured to mate with each other. For example, an embodiment may be described as a first element (functioning as a male) configured to be inserted into a second element (functioning as a female). It should be appreciated that an alternate embodiment includes the first element (functioning as a female) configured to receive the second element (functioning as a male). In either such embodiment, the first and second elements are configured to mate with, fit with or otherwise interlock with each other.

It should be understood that various changes and modifications to the embodiments described herein will be apparent to those skilled in the art. Such changes and modifications can be made without departing from the spirit and scope of the present disclosure and without diminishing its intended advantages. It is therefore intended that such changes and modifications be covered by the appended claims. Although several embodiments of the disclosure have been disclosed in the foregoing specification, it is understood by those skilled in the art that many modifications and other embodiments of the disclosure will come to mind to which the disclosure pertains, having the benefit of the teaching presented in the foregoing description and associated drawings. It is thus understood that the disclosure is not limited to the specific embodiments disclosed herein above, and that many modifications and other embodiments are intended to be included within the scope of the appended claims. Moreover, although specific terms are employed herein, as well as in the claims which follow, they are used only in a generic and descriptive sense, and not for the purposes of limiting the present disclosure, nor the claims which follow.

The following is claimed:

1. A set of archery cam devices, the set comprising:

a first cam device configured to be rotatably coupled to a first limb of an archery bow, the first cam device comprising a first bowstring sheave, a first control sheave, and a first power cable sheave; and a second cam device configured to be rotatably coupled to a second limb of the archery bow, the second cam device comprising a second bowstring sheave, a second control sheave, and a second power cable sheave, wherein the archery bow comprises a riser that comprises a first riser end and an opposing second riser end, wherein, when the first and second cam devices are coupled to the first and second limbs, respectively, while the archery bow is vertically oriented:

a vertical riser plane extends through the first and second riser ends, a vertical bowstring plane extends through the first bowstring sheave and the second bowstring sheave;

a vertical control plane extends through the first control sheave and the second control sheave;

a first vertical power cable plane extends through the first power cable sheave;

a second vertical power cable plane extends through the second power cable sheave;

the vertical bowstring plane and the vertical control plane are located on opposite sides of the vertical riser plane; and the first and second vertical power cable planes are located on opposite sides of the vertical riser plane.

2. The set of archery cam devices of claim 1, wherein:

a first side of the vertical riser plane consists of a first plane portion oriented to face in first direction; and a second side of the vertical riser plane consists of a second plane portion oriented to face in second direction opposite of the first direction.

3. The set of archery cam devices of claim 1, wherein:

a first end of the first limb is coupled to the first end of the riser;

a first end of the second limb is coupled to the second end of the riser;

the first cam device is configured to be rotatably coupled to a second end of the first limb; and the second cam device is configured to be rotatably coupled to a second end of the second limb.

4. The set of archery cam devices of claim 1, wherein each of the first and second control sheaves defines a control groove configured to at least receive a portion of a support cable.

5. The set of archery cam devices of claim 1, wherein:

the first power cable sheave is configured to receive a portion of a first power cable; and the second power cable sheave is configured to receive a portion of the second power cable.

6. The set of archery cam devices of claim 1, wherein each of the first and second bowstring sheaves comprise a groove configured to receive a portion of a bowstring.

7. The set of archery cam devices of claim 1, wherein while the archery bow is vertically oriented, the first and second vertical power cable planes are located to one side of the vertical bowstring plane.

8. A set of archery cam devices, the set comprising:

a plurality of rotors, wherein each of the rotors is configured to be rotatably coupled to one of a plurality of limbs of an archery bow, wherein each of the rotors defines:

(a) a first groove configured to at least partially receive a draw cord of the archery bow;

(b) a second groove configured to at least partially receive a supplemental cord of the archery bow; and (c) a third groove configured to at least partially receive a power cord of the archery bow; and wherein, when the rotors are coupled to the limbs while the archery bow is vertically oriented:

a first vertical plane extends through the first grooves of the rotors;

a second vertical plane extends through the second grooves of the rotors;

a third vertical plane extends through the third groove of one of the rotors;

a fourth vertical plane extends through the third groove of another one of the rotors;

a vertical riser plane extends through a riser of the archery bow, wherein:

a first space extends from the vertical riser plane in a first direction; and a second space extends from the vertical riser plane in a second direction that is opposite of the first direction;

the first plane extends through the first space;

the second plane extends through the second space;

the third plane extends through the first space; and the fourth plane extends through the second space.

9. The set of archery cam devices of claim 8, wherein:

a first side of the vertical riser plane consists of a first plane portion oriented to face in first direction; and a second side of the vertical riser plane consists of a second plane portion oriented to face in second direction opposite of the first direction.

10. The set of archery cam devices of claim 8, wherein:

a first end of a first limb of the plurality of limbs is coupled to the first end of the riser;

a first end of a second limb of the plurality of limbs is coupled to the second end of the riser;

one of the plurality of rotors is configured to be rotatably coupled to a second end of the first limb; and another of the plurality of rotors is configured to be rotatably coupled to a second end of the second limb.

11. The set of archery cam devices of claim 8, wherein each of the rotors comprises a cam.

12. The set of archery cam devices of claim 8, wherein each of the rotors comprises a plurality of sheaves that each defines one of the first, second, and third grooves.

13. The set of archery cam devices of claim 8, wherein while the archery bow is vertically oriented:

the first vertical plane and the second vertical plane are located on opposite sides of the vertical riser plane; and the third vertical plane and the fourth vertical plane are located on opposite sides of the vertical riser plane.

14. The set of archery cam devices of claim 8, wherein:

the draw cord comprises a bowstring;

the supplemental cord comprises a support cable;

the power cord comprises a power cable; and the first space and the second space are located on opposite sides of the vertical riser plane.

15. A method of manufacturing a plurality of rotors, wherein each of the rotors is configured to be rotatably coupled to one of a plurality of limbs of an archery bow, comprising:

structuring each of the rotors to define:

(a) a first groove configured to at least partially receive a draw cord of the archery bow;

(b) a second groove configured to at least partially receive a supplemental cord of the archery bow; and (c) a third groove configured to at least partially receive a power cord of the archery bow; and structuring each of the rotors such that when the rotors are coupled to the limbs while the archery bow is vertically oriented:

a first vertical plane extends through the first grooves of the rotors;

a second vertical plane extends through the second grooves of the rotors;

a third vertical plane extends through the third groove of one of the rotors;

a fourth vertical plane extends through the third groove of another one of the rotors;

a vertical riser plane extends through a riser of the archery bow, wherein:

a first space extends from the vertical riser plane in a first direction; and a second space extends from the vertical riser plane in a second direction that is opposite of the first direction;

the first plane extends through the first space;

the second plane extends through the second space;

the third plane extends through the first space; and the fourth plane extends through the second space.

16. The method of claim 15, further comprising:

structuring a first end of a first limb of the plurality of limbs to be coupled to the first end of the riser;

structuring a first end of a second limb of the plurality of limbs to be coupled to the second end of the riser;

structuring one of the plurality of rotors to be configured to be rotatably coupled to a second end of the first limb; and structuring another of the plurality of rotors to be configured to be rotatably coupled to a second end of the second limb.

17. The method of claim 15, further comprising structuring each of the rotors to comprise a cam.

18. The method of claim 15, further comprising structuring each of the rotors to comprise a plurality of sheaves that each defines one of the first, second, and third grooves.

19. The method of claim 15, further comprising structuring each of the rotors such that while the archery bow is vertically oriented:

the first vertical plane and the second vertical plane are located on opposite sides of the vertical riser plane; and the third vertical plane and the fourth vertical plane are located on opposite sides of the vertical riser plane.

20. The method of claim 15, further comprising:

structuring the draw cord to comprise a bowstring;

structuring the supplemental cord to comprise a support cable;

structuring the power cord to comprise a power cable; and structuring the first space and the second space such that the first space is located on an opposite side of the vertical riser plane than the second space.

21. The method of claim 15, further comprising structuring the archery bow to comprise a riser that comprises a first riser end and an opposing second riser end, wherein a vertical riser plane extends through the first and second riser ends.

22. The method according to claim 15, further comprising structuring:

a first end of the first limb to be coupled to the first end of the riser;

a first end of the second limb to be coupled to the second end of the riser;

the first cam device to be rotatably coupled to a second end of the first limb; and the second cam device to be rotatably coupled to a second end of the second limb.

23. The method of claim 15, further comprising structuring:

the first control sheave and the second control sheave to retain a portion of a support cable; and the first control sheave and the second control sheave to position the support cable along the vertical control plane during a shooting action.

24. The method of claim 15, further comprising structuring:

the first power cable sheave to retain a portion of a first power cable; and the second power cable sheave to retain a portion of the second power cable.

25. The method of claim 15, further comprising structuring:

the first bowstring sheave and the second bowstring sheave to retain a portion of a bowstring; and the first bowstring sheave and the second bowstring sheave to position the bowstring along the vertical bowstring plane during a shooting action.

26. The method of claim 15, further comprising structuring the first bowstring sheave, the second bowstring sheave, the first control sheave and the second control sheave so that while the archery bow is vertically oriented:

the vertical bowstring plane and the vertical control plane are located on opposite sides of the vertical riser plane.

* * * * *